US006038836A

United States Patent [19]

Focke et al.

[11] Patent Number: 6,038,836

[45] Date of Patent: Mar. 21, 2000

[54] PROCESS AND APPARATUS FOR THE OPTOELECTRONIC MONITORING OF PACKAGING MATERIAL

[75] Inventors: Heinz Focke; Martin Stiller, both of Verden, Germany

[73] Assignee: Focke & Co. (GmbH & Co.), Verden, Germany

[21] Appl. No.: 09/015,392

[22] Filed: Jan. 29, 1998

[30] Foreign Application Priority Data

Feb. 7, 1997 [DE] Germany ..... 197 04 718

[51] Int. Cl.[7] ..... B65B 19/28; B65B 43/08; B65B 57/02

[52] U.S. Cl. ..... 53/462; 53/207; 493/10; 250/200; 250/559.12

[58] Field of Search ..... 493/10, 11, 12, 493/13, 14, 15, 911, 910; 250/548, 200, 559.01, 559.12; 53/462, 207

[56] References Cited

U.S. PATENT DOCUMENTS

| | | | |
|---|---|---|---|
| 3,693,313 | 9/1972 | Sexstone | 493/11 X |
| 4,001,579 | 1/1977 | Lebet et al. | 493/12 X |
| 4,085,928 | 4/1978 | Sussman | 493/14 |
| 4,682,038 | 7/1987 | Focke | 250/548 |
| 5,260,583 | 11/1993 | Rye | 250/572 |

FOREIGN PATENT DOCUMENTS

| | | |
|---|---|---|
| 0142129 | 5/1985 | European Pat. Off. . |
| 0677444 | 10/1995 | European Pat. Off. . |
| 0791539 | 8/1997 | European Pat. Off. . |
| 3304299A1 | 9/1983 | Germany . |
| 3601443A1 | 7/1987 | Germany . |
| 3700928A1 | 7/1987 | Germany . |
| 8901733U1 | 5/1989 | Germany . |
| 4100239A1 | 7/1992 | Germany . |
| 2049926 | 12/1980 | United Kingdom . |

*Primary Examiner*—James F. Coan
*Attorney, Agent, or Firm*—Abelman, Frayne & Schwab; Thomas E. Spath, Esq.

[57] ABSTRACT

Process and apparatus for producing packs and for transporting blanks (10), for producing the packs, along a conveying path (11). For the purpose of monitoring and/or for the optoelectronic sensing of the blanks (10), monitoring elements (15) with sensors (16, 17) are arranged in the region of the conveying path (11). The blanks (10) are guided in the region of the monitoring element (15) such that the blanks (10) are moved beyond at least one of the sensors (16, 17) with sliding abutment, in order for the sensor to be cleaned constantly.

17 Claims, 4 Drawing Sheets

PROCESS AND APPARATUS FOR THE OPTOELECTRONIC MONITORING OF PACKAGING MATERIAL

Figure 1:
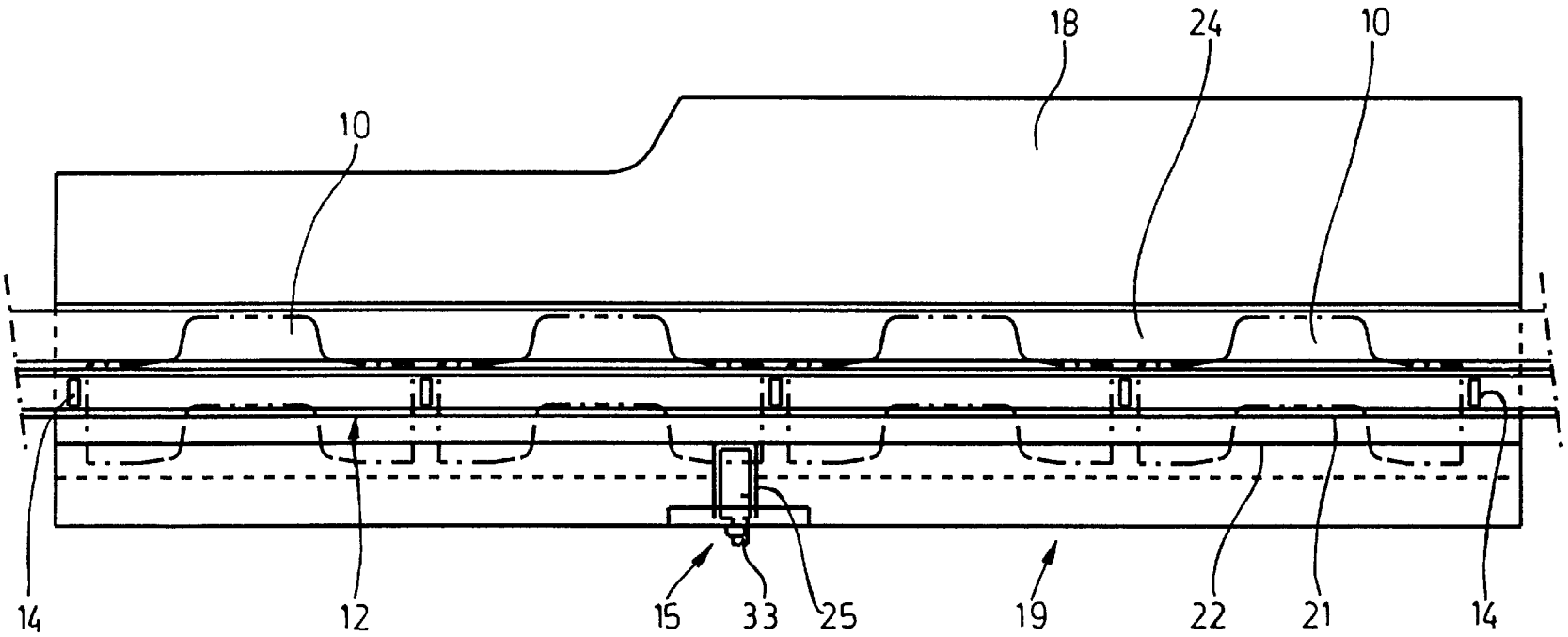

The invention relates to a process and an apparatus for producing packs, in particular cigarette packs, from blanks of a packaging material, in particular paper, thin cardboard or the like, a material web or individual blanks of the packaging material being transported along a conveying path.

For the production of packs, either the blanks of the packaging material are supplied in the ready-cut state to the packaging machine, in the form of stacks of blanks, in particular in the case of hinge-lid packs for cigarettes, or blanks are severed from a material web within the packaging machine. The stringent requirements as regards quality and correct design of the packs mean that the packaging material has to be subjected to frequent monitoring and controls.

The object of the invention is to propose an effective and efficient method of monitoring packaging material, in conjunction with packaging machines, which operates without errors on a permanent basis.

In order to achieve this object, the process according to the invention is characterized by the following features:

a) the material web or the blanks is/are sensed in the region of the conveying path by optoelectronic monitoring elements with at least one sensor, b) the material web or the blanks is/are moved past the monitoring element, with abutment against at least one sensor, such that the sensor is cleaned (constantly) by the material web or the successive blanks.

The monitoring element equipped with sensors mainly serves for detecting defects on the material web or on the blanks. However, it is also possible for the monitoring elements to respond to other features of the packaging material, for example to marks provided on the packaging material for the purpose of controlling elements.

The monitoring elements operate with light signals, in particular with a light beam as checking beam. The satisfactory operation of such monitoring elements depends on whether the light-emitting and/or light-receiving sensors are in a satisfactory state. Deposits of dust and other contaminants impair or prevent operation.

The invention achieves, in a simple manner, constant automatic cleaning by the packaging material itself, namely by the material web or the individual blanks directed past the sensors, with abutment against the outer, free surface of the latter. This frictional contact constantly removes contaminants or prevents the latter from being deposited on the sensors.

For the purpose of carrying out the process, the material web or blanks is/are transported along the guide-containing conveying path. A monitoring element or a plurality of monitoring elements is/are arranged in the region of said conveying path, such that at least one (bottom) sensor is cleaned by virtue of the abutment of the packaging material. The monitoring elements are preferably designed in the form of a U, namely as a so-called fork-shaped light barrier with two spaced-apart legs, between which the packaging material is guided. The packaging material preferably acts, by virtue of abutment, on the sensor in the region of the bottom leg.

According to the invention, the monitoring elements are of a special design, that is to say they comprise a solid body with cavities for receiving optical and, if appropriate, electrically conducting elements, which are fixed within the cavities by an embedding compound.

Figure 2:
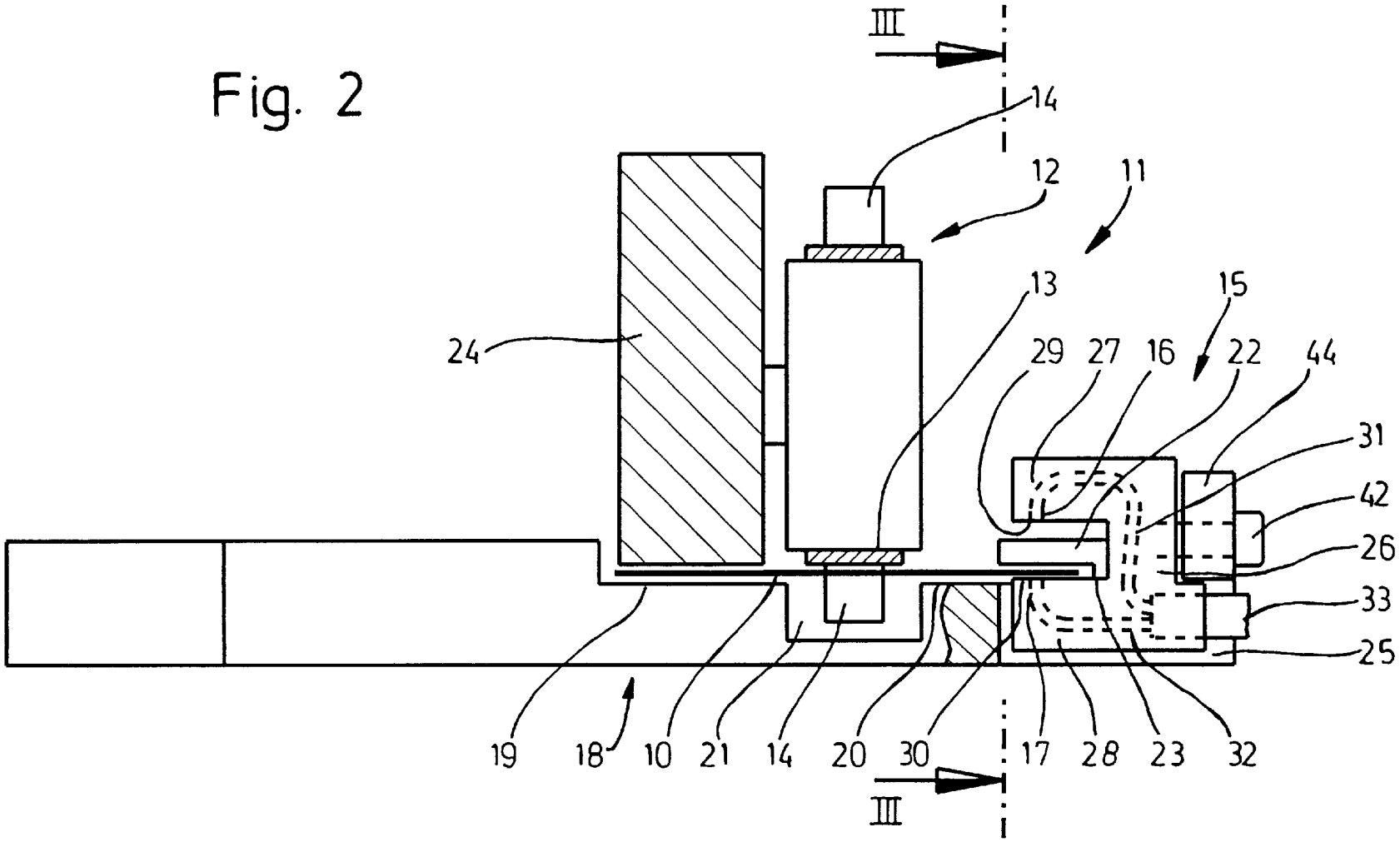
Figure 3:
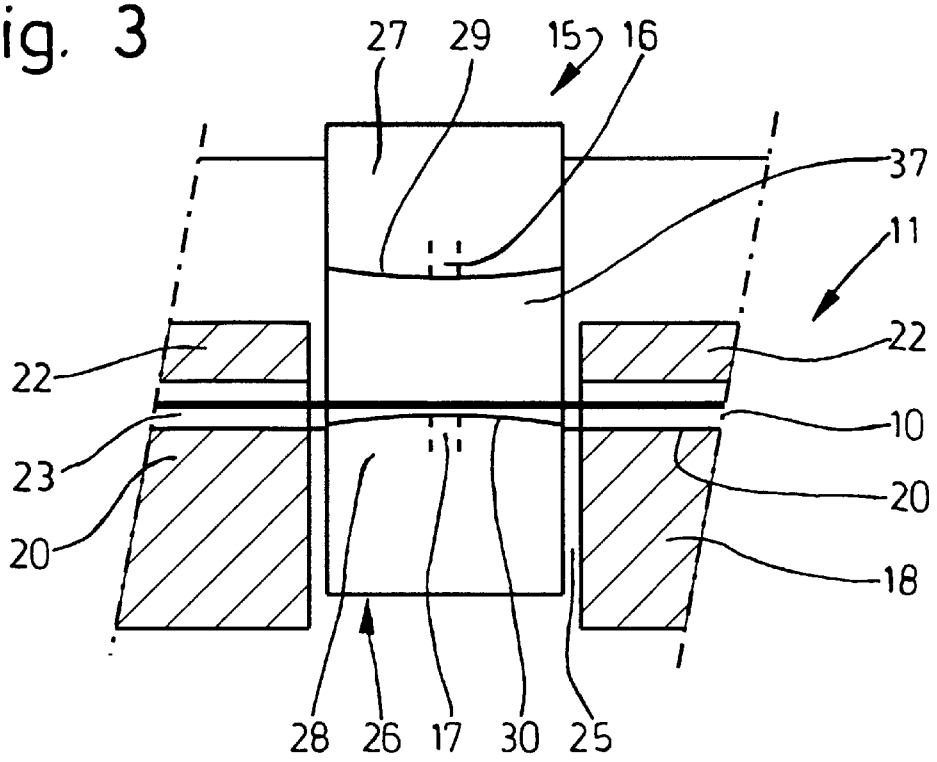
Figure 4:
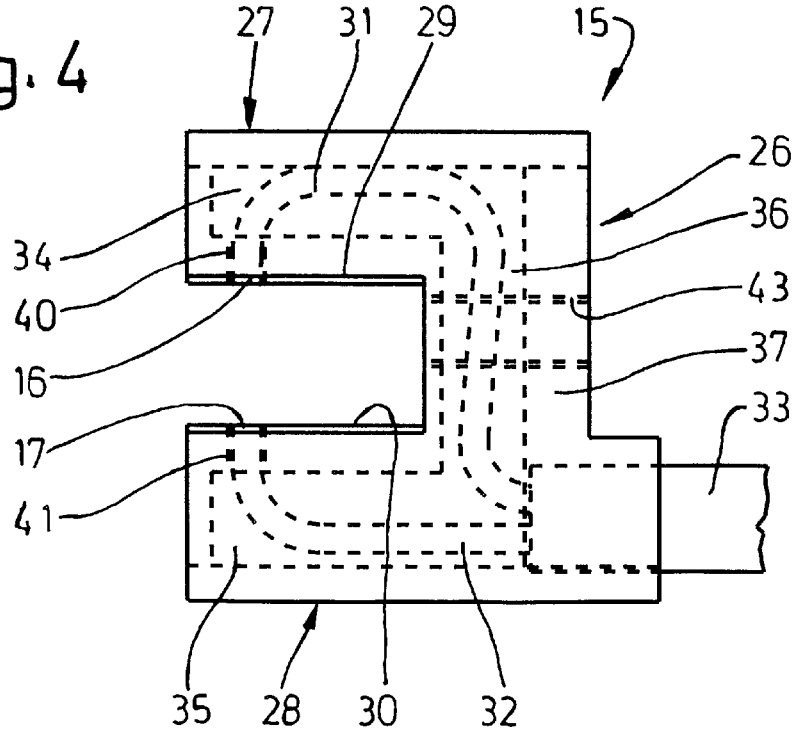
Figure 5:
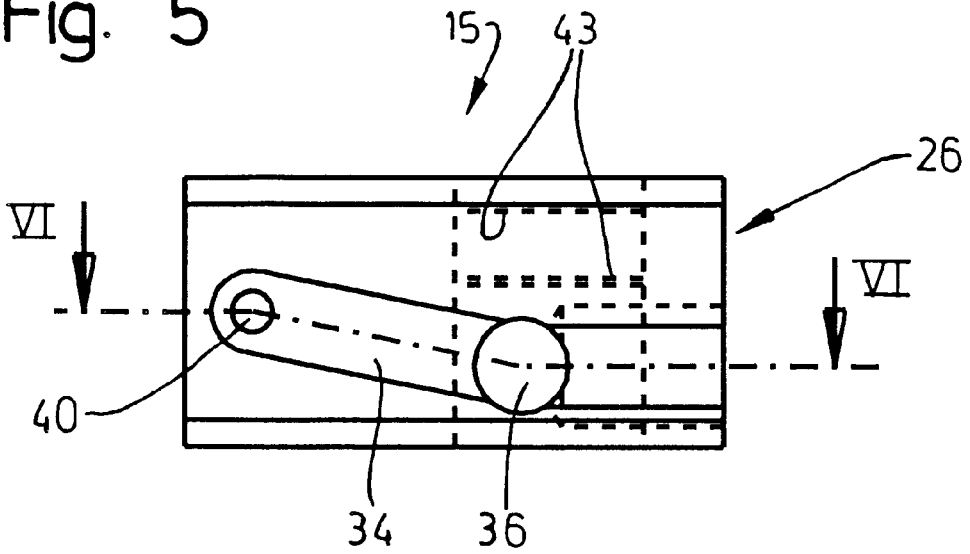
Figure 6:
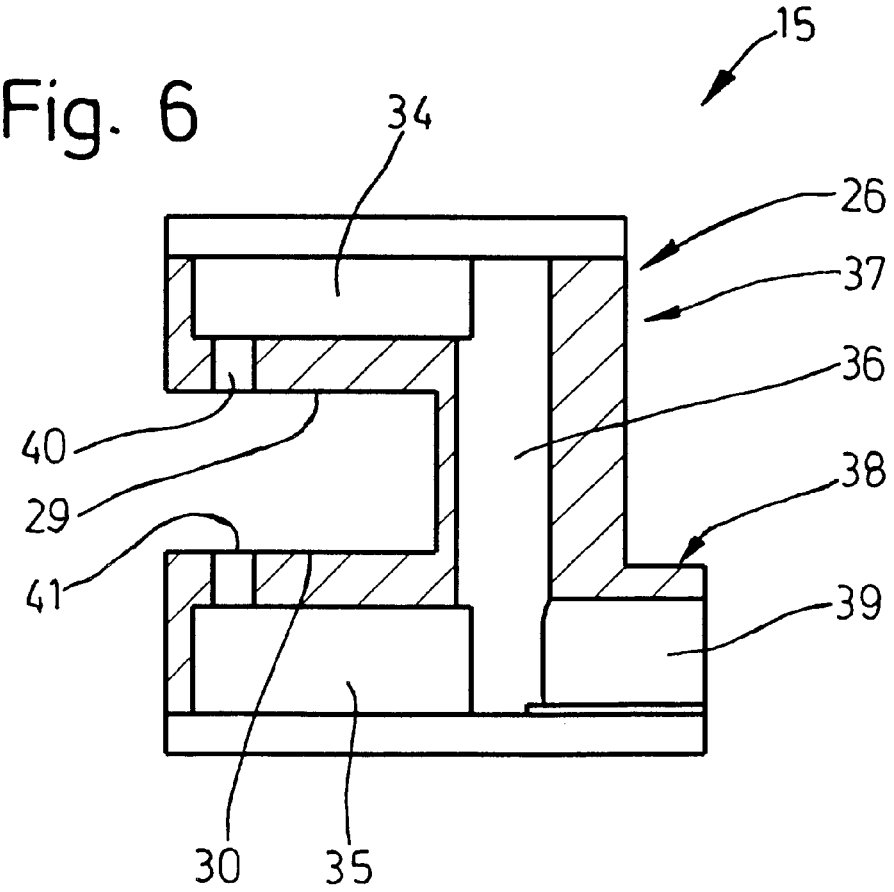

Further details of the invention relate to the configuration of the conveying path and of the monitoring elements. An exemplary embodiment of the apparatus according to the invention is explained in more detail hereinbelow with reference to the drawings, in which:

FIG. 1 shows a schematic plan view of a conveying path for packaging material, namely blanks, FIG. 2 shows, on an enlarged scale, the conveying path according to FIG. 1 in cross-section in the region of a monitoring element, FIG. 3 shows a detail of FIG. 2, partly in section along the plane III—III of FIG. 2, FIG. 4 shows a side view of a monitoring element shown in FIG. 3, FIG. 5 shows a plan view of the monitoring element according to FIG. 4, and FIG. 6 shows the monitoring element according to FIG. 5 in a vertical section along the section plane VI—VI in FIG. 5.

The drawings give an advantageous exemplary embodiment and application example, namely the handling of blanks 10 made of packaging material, that is to say of thin cardboard. The blanks 10 are those which are used for a collar of a cigarette pack of the hinge-lid type.

The blanks 10, which are produced elsewhere, are transported along a conveying path 11. The latter may run horizontally or in an inclined plane. In the region of the conveying path 11, the blanks 10 are transported at a small distance apart from one another. Provided for this purpose is an endless conveyor, namely a belt conveyor 12, which is mounted above the movement path of the blanks 10. The blanks 10 are conveyed, preferably continuously, by a bottom strand 13. Provided on the belt conveyor 12, for this purpose, are projecting carry-along elements 14 which are arranged at regular intervals from one another and each grip a blank 10 at a rear edge, as seen in the conveying direction.

The blanks 10 are moved past a stationary monitoring element 15 in the region of the conveying path 11. Said monitoring element may serve for detecting any defects as regards the configuration of the blanks 10 and, if appropriate, for producing an error signal. The monitoring element 15 can also detect the correct distance between the blanks 10 or the presence of an uninterrupted sequence of blanks 10.

The monitoring element 15 is positioned in a stationary manner to the side in the longitudinal centre of the conveying path 11. It comprises two sensors 16 and 17 which are positioned on opposite sides of the movement path of the blanks 10, namely above and beneath said movement path. One of the sensors is designed as a transmitter and the other sensor is designed as a receiver. Passing between the sensors 16, 17 is a checking beam, namely a light beam, which is interrupted temporarily by the blanks 10. For this purpose, the blanks 10 are conveyed through between the sensors 16, 17 by way of the (border) region which is to be checked.

The conveying path 11 comprises a continuous, panel-like bottom guide 18. The spread-out blanks 10 rest on conveying surfaces 19 and 20 of the bottom guide 18. Running along centrally in the conveying direction is a groove-like depression 21 into which the carry-along elements 14 of the belt conveyor 12 pass. The spread-out blanks 10 cover over the depression 21. The conveying path 11 is also assigned top guides for the blanks 10. These act in the border regions of the blanks 10. A top guide 22, which is designed as the horizontal leg of the bottom guide 18 and is connected to the latter, is arranged on one side of the conveying path 11. A gap 23 which runs in the conveying direction and is intended for guiding the blanks 10 is produced between the bottom guide 18 and top guide 22.

A guide, namely a carrying wall 24, is likewise arranged above the blanks 10 on the opposite side. The belt conveyor 12 is also mounted on said carrying wall with deflection rollers. The carrying wall 24 is held a small distance above the movement path of the blanks 10. Otherwise, the arrangement and design of the conveying path 11 corresponds to that in U.S. Pat. No. 4,938,005. This means that the carrying wall 24 can be raised with the belt conveyor 12 in order to eliminate any defects in the region of the conveying path 11.

The monitoring element 15 is positioned in a recess 25 of the conveying path 11, namely of the bottom guide 18 and the top guide 22.

The monitoring element 15 comprises a housing 26. In this case, said housing is of fork-shaped design, that is to say it has a top leg 27 and a bottom leg 28. That region of the blanks 10 which is to be monitored is conveyed through between the two legs 27, 28. The top sensor 16 is located in a downwardly directed sensor surface 29 of the top leg 27. The bottom sensor 17 is positioned opposite in the region of a bottom, horizontal sensor surface 30.

The sensors 16, 17 are connected to a cable 33 via lines 31 and 32 within the housing 26 or open out into this cable. The cable 33 passes out of the housing 26 and leads to a source for the checking beam, in particular to light source, on the one hand and to a (optoelectronic) evaluating means (not shown) on the other hand. The lines 31, 32 are preferably glass-fibre strands, to be precise made of (genuine) glass. These open out in the region of the sensor surfaces 29, 30. The ends of the glass-fibre strands (lines 31, 32) directly form the sensors 16, 17, that is to say transmitter and receiver of the light beam.

At least one of the sensors 16, 17 is positioned with respect to the movement path of the blanks 10 such that the latter are moved past the relevant sensor, in the present case the bottom sensor 17, with contact. This frictional contact between the blanks 10 and the sensor 17 ensures constant, effective cleaning of the sensor 17 and/or ensures that the latter is kept free of dust and other deposits.

A slight contact-pressure force of sufficient magnitude exerted by the blanks 10 on the sensor 17 may be achieved in various ways. It is sufficient for the blanks 10 to slide past the sensor 17 essentially under their own weight, if appropriate with slight deflection from the plane of the movement path. In the case of the present exemplary embodiment, for this purpose, the bottom sensor surface 30 is designed as an elevation in the region of the movement path of the blanks 10. As is shown, the sensor surface 30 is elevated with respect to the movement path, predetermined by the bottom guide 18, of the blanks 10 and is designed as a curved surface. The sensor 17 is located at the highest point of the (arcuate) sensor surface 30.

A further special feature involves the configuration of the monitoring element 15. The housing 26 consists of rigid material, in particular metal. The interior of the housing 26 is formed with cavities in which the devices and lines of a monitoring element 15 are arranged and fixed by means of embedding compound. Accordingly, first of all, the monitoring element 15 is provided, in the cavities, with the devices and lines for carrying out the monitoring operation. Thereafter, the free spaces which remain are filled with an initially free-flowing, solidifying compound, in particular with synthetic resin.

In the case of the present exemplary embodiment, a top chamber 34 is formed in the top leg 27 of the housing 26 and a bottom chamber 35 is formed in the bottom leg 28 of the housing 26. The chambers 34 and 35 are connected to one another by an upright duct 36 in a web 37 of the U-shaped housing 26. Provided in the region of a bottom base 38 is an outlet duct 39, which adjoins the interior. The top chamber 34 and the bottom chamber 35 are each adjoined by bores 40, 41, which open out in the region of the sensor surface 29, 30. These bores 40, 41 serve for the through-passage of the lines 31, 32 and/or for the arrangement of the sensors 16, 17. Within the housing 26, the top line 31 runs in the top chamber 34 and in the upright duct 36 as far as the outlet duct 39, namely as far as the cable 33. The bottom line 32 leads from the sensor surface 30 to the cable 33 via the chamber 35.

For the purpose of introducing the embedding compound into the cavities, the housing 26 is provided, at the top and bottom, with coverings in the region of the cavities, in particular with covering plates made of plastic or metal which are pressed against the embedding compound before it sets and are thus connected thereto.

In the present case, the monitoring element 15 or the housing 26 is fitted on the conveying path 11 by means of a fastening element, to be precise by means of a fastening bolt 42 which passes through a laterally offset opening 43 in the web 37 of the housing 26. The fastening bolt 42 connects the monitoring element to an upright carrying leg 44 of the bottom guide 18.

Instead of the handling of blanks 10, which is portrayed by way of the exemplary embodiment, it is also possible for continuous material webs, even those with printed marks for the purpose of controlling elements of the packaging machine, to be sensed in the manner described. In this case, at least one sensor is cleaned continuously by the abutting material web. If the packaging material is of appropriate design, a rough side may be directed downwards, or towards the sensor which is to be cleaned.

Moreover, it is advantageous for the process and the apparatus described to be used in conjunction with a system corresponding to DE 196 07 215.

Patent claims:

1. Process for producing packs, from blanks (10) of a packaging material, being transported along a conveying path (11), characterized by the following features:

a. the blanks (10) are sensed in the region of the conveying path (11) by optoelectronic monitoring elements (15) with at least one sensor (16, 17), and b. the blanks (10) are moved past the monitoring element (15), with abutment against at least one sensor (16, 17), such that the sensor (17) is cleaned, by virtue of sliding abutment with the blanks (10).

2. Process according to claim 1, characterized in that the the blanks (10) are pressed against the sensor under their own weight and resulting in deflection of blanks (10) against the sensor.

3. Apparatus for producing packs, from blanks (10) of a packaging material, transported along a conveying path (11), to a folding unit, characterized in that positioned in the region of the conveying path (11) is at least one monitoring element (15) for the optoelectronic sensing of the blanks (10), and in that, during transport relative to the monitoring element (15), the the blanks (10) can be moved past the monitoring element (15), with abutment against at least one sensor (17) thereof, such that the sensor (17) is cleaned by sliding abutment of the blanks (10).

4. Apparatus according to claim 3, characterized in that the at least one sensor (17) is arranged in the region of an elevated sensor surface (30) of the monitoring element (15), in the region of a convex or curved sensor surface (30), the sensor (17) which is to be cleaned being positioned at the highest point of the sensor surface (30).

5. Apparatus according to claim 3 characterized in that along the conveying path (11), at least in the region of the monitoring element (15), the blanks (10) rest on a bottom guide (18), at least a portion of the sensors (17) to be cleaned being elevated with respect to a conveying surface (20) of the bottom guide (18), with a curved design of the sensor surface (30) adjoining the conveying surface (20).

6. Apparatus according to claim 3, characterized in that the monitoring element (15) includes a fork-shaped light barrier with a U-shaped housing (26), having legs (27, 28) to provide mutual facing sensor surfaces (29, 30), in the region that the sensors (16, 17) are arranged, with at least a border region of the blanks being transported between the legs (27, 28).

7. Apparatus according to claim 3, characterized in that the blanks (10) are monitored by means of check light, supplied via lines (31, 32) which are routed within the housing (26) of the monitoring element (15) and comprise glass-fiber strands in bundles opening out, as sensor (16, 17), at mutually opposite regions of the sensor surfaces (29, 30).

8. Apparatus according to claim 3, characterized in that the monitoring element (15) includes a housing (26) having a hollow body for receiving optical installation elements fixed within the cavities of the hollow body by an initially free-flowing, solidifying embedding compound.

9. Apparatus according to claim 8, characterized in that the housing is U-shaped (26) including top leg (27) and bottom leg (28), each leg having a chamber (34, 35) for supply lines (31, 32) and, a web (37), an upright duct (36) being adjoined, in the bottom region of the housing (26), by an outlet duct (39) for a cable (33).

10. Apparatus for producing packs from blanks (10) of a packaging material being transported along a conveying path (11), characterized by the following features:

a. at least one monitoring element (15) for the optoelectronic sensing of blanks (10), is positioned in the region of the conveying path (11), b. said monitoring element (15) includes at least one sensor (16, 17), c. said blanks (10) are transported along the conveying path past the monitoring element (15) in such a way that said sensor (16, 17) is at least temporarily covered by said blanks, d. said sensor (17) is positioned in the region of an elevated sensor surface (30) which protrudes in the direction of the passing blanks (10), centered at the farthest protruding position of the sensor surface (30), e. during transport along the conveying path (11), the blanks (10) move past said monitoring element (15) while abutting the raised or protruding sensor surface (30), whereby the blanks (10) exert a cleaning effect on the sensor (16, 17).

11. Apparatus according to claim 10, characterized by the following features:

a. while the blanks (10) move along the conveying path (11), the blanks (10) rest on a bottom guide (18) at least in the region of the monitoring element (15), b. said bottom guide (18) forms a conveying surface (20) running at its edge on which a partial area of the blanks (10) lie during transport along the conveying path (11), c. said monitoring element (15) is positioned in the region of the bottom guide (18) such that a bottom sensor (17) is arranged in the region of the conveying surface (20) of the bottom guide (18), d. at least a portion of the sensor (17) projects above the level of the conveying surface (20) of the bottom guide (18) in such a way that the blanks (10) can be moved past the monitoring element (15) while abutting the sensor (17).

12. Apparatus according to claim 11, wherein said portion of the sensor (17) which projects above the level of the conveying surface is said protruding sensor surface (30).

13. Apparatus according to claim 10, characterized by the following features:

a. said monitoring element (15) is fork-shaped with a U-shaped housing (26), having legs (27, 28) with respective sensors (16, 17), b. a border region of the blanks (10) are transported between the legs (27, 28) of the housing (26) in such a way that the sensors (16, 17) are at least temporarily covered, c. the monitoring of the material web or of the blanks (10) is carried out by means of checking light which is delivered to and lead away from the sensors (16, 17) by means of lines (31, 32) made of glass-fiber strands which run within the housing (26).

14. Apparatus according to claim 11, characterized by the following features:

a. said monitoring element (15) is fork-shaped with a U-shaped housing (26), having legs (27, 28) with respective sensors (16, 17), b. a border region of the blanks (10) are transported between the legs (27, 28) of the housing (26) in such a way that the sensors (16, 17) are at least temporarily covered, c. the monitoring of the material web or of the blanks (10) is carried out by means of checking light which is delivered to and lead away from the sensors (16, 17) by means of lines (31, 32) made of glass-fiber strands which run within the housing (26).

15. Apparatus according to claim 10, characterized in that said monitoring element (15) includes a housing (26) having a hollow body defining cavities for receiving optical elements fixed within said cavities by an initially free-flowing, solidifying embedding compound of synthetic resin.

16. Apparatus according to claim 10, characterized in that said monitoring element (15) includes a housing (26) defining a hollow body including cavities for receiving electrical installation elements fixed within sid cavities by an initially free-flowing, solidifying embedding compound of synthetic resin.

17. Apparatus according to claim 15, characterized in that said housing (26) is U-shaped, and including a top leg (27) and bottom leg (28), said legs including chambers (34, 35) for transmitting lines (31, 32), in a web (37), and an upright duct (36) being adjoined, in the bottom region of the housing (26), by an outlet duct (39) for a cable (33).

* * * * *